United States Patent [19]

Byrd et al.

[11] 4,125,009

[45] Nov. 14, 1978

[54] BLANK AND DRAW APPARATUS WITH GAP CONTROL

[75] Inventors: James I. Byrd; Elton G. Kaminski, both of Sidney, Ohio

[73] Assignee: The Stolle Corporation, Sidney, Ohio

[21] Appl. No.: 791,859

[22] Filed: Apr. 28, 1977

[51] Int. Cl.[2] ..... B21D 22/00

[52] U.S. Cl. ..... 72/350; 72/361

[58] Field of Search ..... 72/350, 351, 347, 361

[56] References Cited

U.S. PATENT DOCUMENTS

| | | | |
|---|---|---|---|
| 2,075,847 | 4/1937 | Holtersoll | 72/351 X |
| 2,177,027 | 10/1939 | Plumb | 72/351 X |
| 2,514,005 | 7/1950 | Middleton et al. | 72/350 X |
| 3,202,411 | 8/1965 | Heiser | 72/351 X |
| 3,435,653 | 4/1969 | Scaletta | 72/351 X |
| 3,550,421 | 12/1970 | Stolell | 72/350 X |

*Primary Examiner*—Leon Gilden

*Attorney, Agent, or Firm*—Melville, Strasser, Foster & Hoffman

[57] ABSTRACT

Apparatus for drawing, or blanking and drawing, a flat metallic piece into a cup shape. A blanking punch, blanking die, draw die, movable stripper and a spacer are mounted on the stationary bed of a press. A pressure pad and draw punch are carried by the ram of a press. The pressure pad is positioned to contact first the blanking punch, then to contact the movable stripper and push it solidly against the spacer. As the ram continues its downward movement, the pressure pad collapses with respect to the ram by virtue of its connection to a piston operating in a cylinder in the ram containing controllable air pressure. The maintenance of a predetermined pressure pad-draw die gap during the draw prevents wrinkling, and the maintenance of the controlled pressure on the pressure pad prevents thinning and subsequent clipping of ears. The edge of the blank which is captured between the pressure pad and draw die is gradually pulled radially inward as the die approaches the bottom of its stroke and the wrinkling and thinning and clipping of ears of the blank which would take place during this pulling is prevented. On the upstroke of the ram air is injected into the draw punch to assist in stripping the finished cup from the punch, and the blanking punch and mounting plate are raised by springs, and the movable stripper raises the scrap upward for removal.

7 Claims, 2 Drawing Figures

BLANK AND DRAW APPARATUS WITH GAP CONTROL

BACKGROUND OF THE INVENTION

When flat metallic material is drawn into a cup shape or it is blanked and drawn simultaneously, the material must be confined between a pressure pad and a draw die to prevent wrinkles. Pressure is generally exerted pneumatically and the amount of pressure exerted on the edges of the blank must be sufficient to prevent wrinkling. If the pressure is too high the metal will not be permitted to move and the draw punch will simply punch a hole through the metal blank. Wrinkling occurs almost immediately at the start of the drawing operation if the clamping pressure between the pressure pad and the draw die is sufficient. Once the direct pressure for wrinkle prevention is established and the depth of draw progresses, the area of undrawn metal must sustain all of the originally established clamping pressure because of the progressive decrease in blank size.

During metal drawing operations a phenomenon generally known as "earing" occurs. This is generally manifested by the formation of ears at approximately 45° to the direction of rolling of the material from which the blank is punched. The explanation for this phenomenon is not clear but in general metal at 0° and 90° of the rolling direction will drawn uniformly with respect to the rolling direction, whereas metal at 45° points will slip along elongated grains. Due to this slippage it does not thicken as much as the metal at the 0° and 90° points and therefore the ears are produced at 45° points. These ears will be thinned and be pinched off and result in contamination of the tooling and must be removed.

Various attempts have been made to avoid the problems of earing and wrinkling and have not been uniformly successful.

According to the present invention, the ram of the press which carries the draw punch assembly and which it is arranged to reciprocate for performing the draw, is provided with a cylinder and a piston therein which piston, through a plurality of pressure pins, bears on a pressure pad.

The bed of the press carries the draw die and if desired also a blanking die and a blanking punch. A controlled air pressure is applied to the upper side of the piston in the ram and maintained at a constant value. Therefore, as the ram descends and the pressure pad bears against the blank resting on the draw die and the draw punch begins to enter the draw die to perform the cup drawing operation, the pressure pad resting on the draw die through the pressure pins bearing against the underside of the piston forces the piston up against the controlled constant air pressure and thus a constant pressure is maintained on the edge of the blank.

The bed also carries a blanking die and a blanking punch and the pressure pad has a flange arranged to bear against the blanking punch as the pressure pad enters the blanking punch to bear against the metal to be drawn. The flange on the pressure pad bearing on the blanking punch causes the blanking punch to blank out the material resting on the draw die in cooperation with the blanking die.

The metal sheared off by the blanking punch and die is pinched between the blanking punch and a movable stripper and a movable stripper is provided with a spacer so that the pressure pad in bearing against the blanking punch cannot approach the draw die beyond a predetermined point, thereby maintaining a predetermined gap between the pressure pad and draw die.

By virtue of the maintenance of the predetermined pressure pad-draw die gap and maintenance of the predetermined air pressure on top of the piston in the ram, thinning and clipping of ears and wrinkling are prevented.

DETAILED DESCRIPTION

Figure 1:
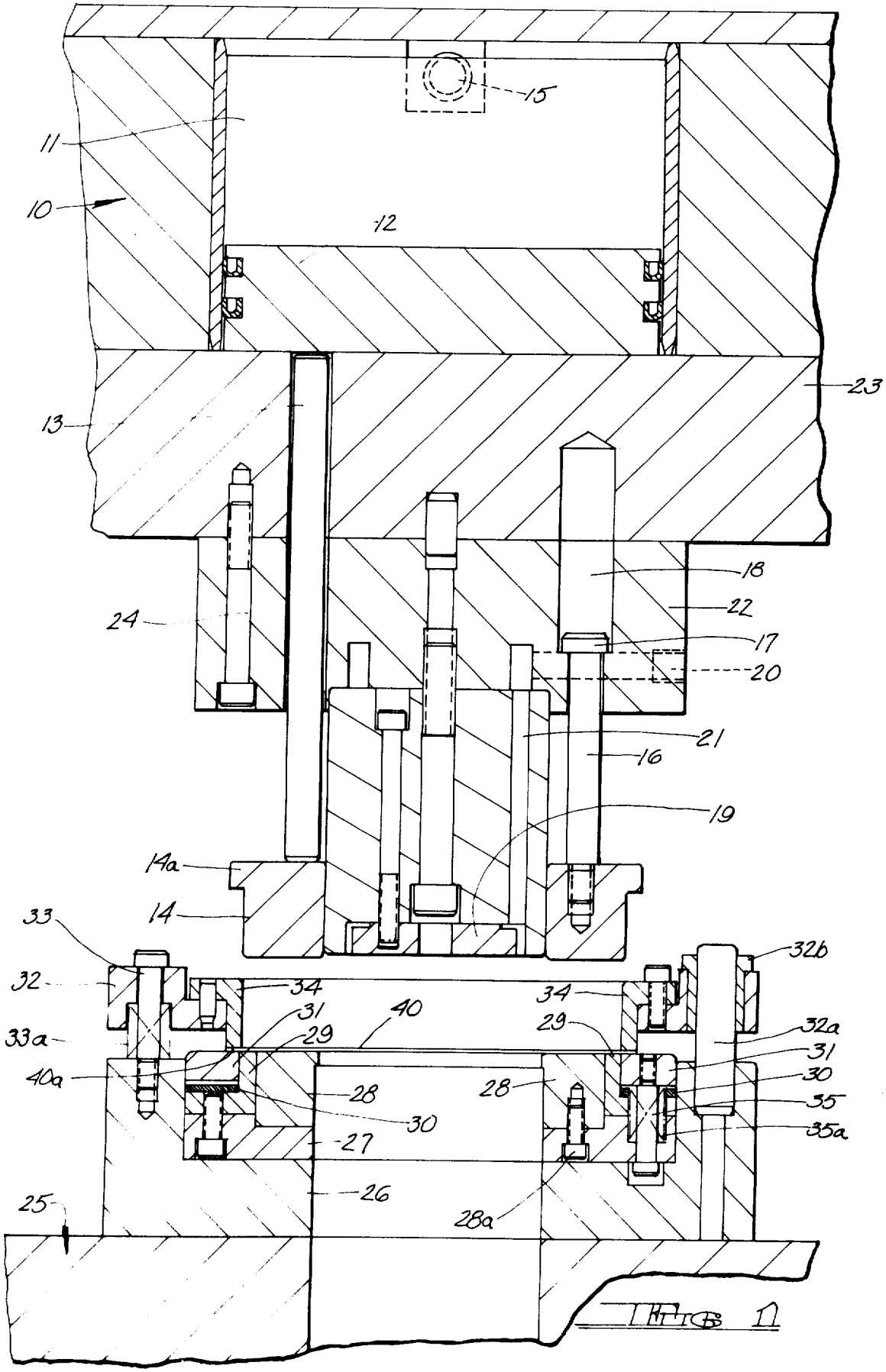
FIG. 1 is a vertical cross sectional view taken on two different radii from the center line showing somewhat diagrammatically a draw press with the ram in raised position out of contact with the bed.

Referring first to FIG. 1, the ram is generally indicated at 10. A cylinder 11 is provided in the ram and a piston 12 operates in the cylinder 11. The ram carries a plurality of pressure pins 13 which are adapted to bear against the pressure pad 14. Air under pressure is supplied to the cylinder 11 through a fitting 15 and by virtue of the clearance between the pressure pins 13 and the apertures through which they pass the lower side of the piston 12 is vented to atmosphere. It will be observed that a plurality of guide bolts 16 are secured to the pressure pads 14 and these guide bolts have heads 17 which move in bores 18 in the ram. A draw punch assembly is indicated at 19 and will not be described further because it does not constitute a part of the invention. It may be noted that an air inlet is provided at 20 and a bore at 21 through the die so that air may be admitted at 20 to assist in stripping the finished cup from the punch at the completion of the draw. The portion 22 of the ram is secured to the portion 23 by means of bolts 24.

The bed of the press is indicated generally at 25. A portion 26 which is a part of the tooling of the press has a recess within which an annular member 27 is disposed. The draw die 28 rests on the member 27 as does the blanking die 29. Also resting on the blanking die 29 is a spacer 30 and a movable stripper 31.

A mounting plate 32 containing bushings **32*b* is carried on the guide rods 32*a* and the mounting plate 32 carries the blanking punch 34. Springs 33*a* surround the bolts 33 which lift the mounting plate 32 against the heads of bolts 33. Springs 35*a* surround the guide bolts 35 which guide the movable stripper 31. The draw die is secured in the member 27 by means of the bolts 28*a***.

A piece of metal which is to be drawn is placed in the assembly as indicated at 40. If the piece is already blanked and is only to be drawn, the blanking die and punch 29 and 34 will of course perform no function. As the ram 10 descends the pressure pad 14, which has the annular flange **14*a*, enters into the blanking punch 34 until the pressure pad 14 rests against the work piece 40 which is resting on the draw die 28. The flange 14*a* of the pressure pad will abut the blanking punch 34 and press it against the movable stripper 31 and spacer 30 whereby a predetermined gap is maintained between the pressure pad 14 and the draw die 28**.

With a predetermined air pressure on top of the piston 12 in the cylinder 11 the draw punch 19 will now enter the draw die and will begin to draw the work piece 40 and as it does so, the pressure pad is maintained at a constant pressure against the work piece since the pressure pins 13 operating against the piston 12 will push it upward in the cylinder 11 against the controlled air pressure on top of the piston, thereby maintaining a constant pressure of the pressure pad 14 against the draw die 28.

As the draw progresses, the work piece is formed into a cup and the edge of the work piece is gradually pulled radially inward from between the pressure pad and the top of the draw die; and when the draw is completed and the ram 10 is retracted upwardly, air is introduced at 20 to strip the formed cup 41 (FIG. 2) from the draw punch assembly 19. If the work piece 40 is to be blanked at the time of drawing, then of course the abutment of the flange 14*a* of the pressure pad against the blanking punch 34 will cause the latter, in cooperation with the blanking die 29, to form the blank and in that case the scrap indicated at 40*a* is simply pinched between the blanking punch and the movable stripper. When the draw is completed the springs 35*a* push the movable stripper up so that the scrap can be removed.

Figure 2:
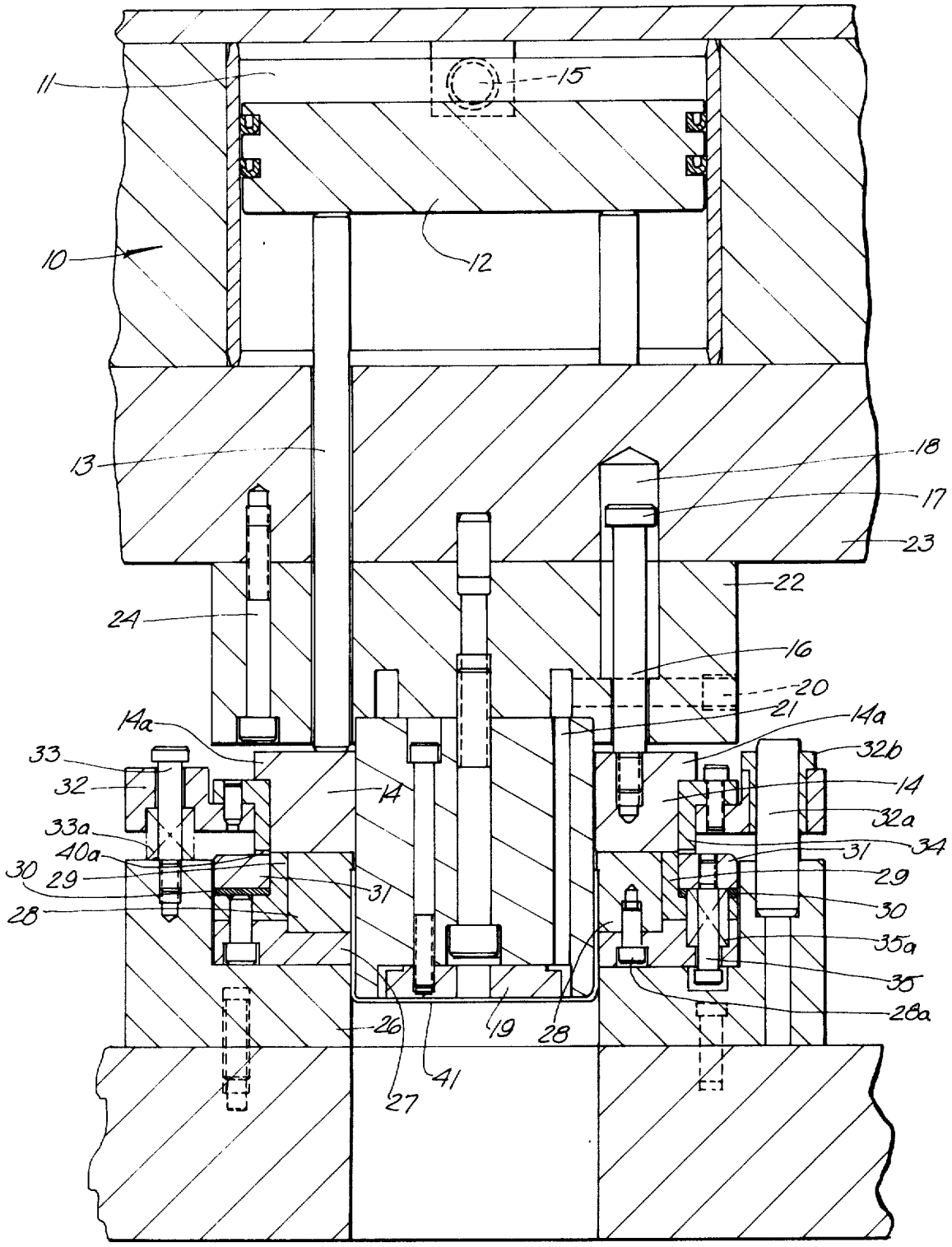
FIG. 2 is a view similar to FIG. 1 but showing the parts at the completion of the draw.

FIG. 2 shows the parts at the point where the draw is complete and the ram is at the bottom of its stroke.

From the foregoing description it will be clear that as the down stroke proceeds and the pressure pad 14 contacts the blanking punch 34, a blank 40 is created. As the ram proceeds, the movable stripper 31 collapses downward and contacts the spacer 30 solidly. This solid contact prevents the pressure pad 14 from approaching any closer to the blanking die 29. As the ram continues its downward movement, the pressure pad 14 collapses through the pressure pins 13 acting on the piston 12. The blank size decreases as the part is drawn and since the gap between the pressure pad and draw die cannot close, this maintained gap prevents the pinching of ears and clipping described above.

If material of a thickness of 0.010 inch (0.25 mm) is to be drawn, the gap would be set for approximately 0.007 inch (0.18 mm). It is this difference between the gap space and the metal thickness which permits clamping of the material to prevent wrinkling but controls the gap to a minimum to prevent clipping of ears.

As the upstroke of the ram starts, air is injected as indicated at 20 to assist in stripping the finished cup from the punch. Subsequently the blanking punch 34 and mounting plate 32 are lifted by the springs 33*a* and the assembly is guided upward on the guide rods 32*a* against the heads of the bolts 33.

The amount of pressure required in order to form a draw without wrinkling is generally determined by actual tooling tryouts. The pressure chamber may also be used to provide the necessary effort for blanking and this of course requires some additional pressure. By way of example, if a draw requires 70 psi (49217 kg/m$^2$) an additional amount would be required for blanking and the cylinder pressure would then be regulated at about 80 psi (56248 kg/m$^2$).

It will be noted that the blanking punch is maintained in close proximity to the blanking die and this arrangement provides for accurate alignment between the blanking punch and blanking die. This is particularly critical on thin gauge material and besides it provides for easy maintenance and replacement of the blanking punch 34 and blanking die 29. This is a substantial improvement over conventional presses wherein the blanking punch is usually affixed to the movable ram and alignment with the blanking die is dependent on the accuracy of the gibs which guide the movable ram.

It will be clear that numerous modifications may be made without departing from the spirit of the invention and therefore no limitation which is not set forth in the claims is intended and no such limitation should be implied.

The embodiments of the invention in which an exclusive property or privilege is claimed are defined as follows:

1. In a drawing press having a fixed bed and a reciprocable ram, for drawing a metallic blank into a cup, said bed carrying a draw die and said ram carrying a draw punch, a pressure pad carried by said ram and urged against said draw die to clamp the edge of said blank during the draw, means establishing a predetermined gap between said pressure pad and draw die in relation to the thickness of said blank, comprising an annular flange on said pressure pad and an abutment in said bed to limit the movement of said pressure pad upon movement of said ram to provide said predetermined gap, and means to maintain a constant pressure on said pressure pad during the draw.

2. Apparatus according to claim 1 wherein said gap is established at about 70% of the thickness of said metallic blank.

3. Apparatus according to claim 1 wherein said bed also carries a blanking punch and a cooperating blanking die disposed above said draw die, said pressure pad having an annular flange to engage said blanking punch when said pressure pad enters said blanking punch, to cause said blanking punch, in cooperation with said blanking die, to punch out a blank, a movable stripper surrounding said blanking die and engaged by said blanking punch through the scrap punched out by said blanking punch and die, and a spacer disposed under said stripper to limit the movement of said blanking punch and therefore of said pressure pad, to maintain said predetermined gap.

4. Apparatus according to claim 1 wherein said means to maintain a constant pressure on said pressure pad comprises a cylinder in said ram, a piston in said cylinder, means connecting said piston with said pressure pad, and means to maintain a predetermined constant pressure on the top of said piston, the underside of said piston being vented to atmosphere.

5. Apparatus according to claim 4 wherein said means to establish a predetermined gap between said pressure pad and draw die comprises an annular flange on said pressure pad and an abutment in said bed to limit the movement of said pressure pad upon movement of said ram to provide said predetermined gap.

6. Apparatus according to claim 1 wherein said bed also carries a blanking punch and a cooperating blanking die disposed above said draw die, said pressure pad having a annular flange to engage said blanking punch when said pressure pad enters said blanking punch, to cause said blanking punch, in cooperationg with said blanking die, to punch out a blank, a movable stripper surrounding said blanking die and engaged by said blanking punch through the scrap punched out by said blanking punch and die, and a spacer disposed under said stripper to limit the movement of said blanking punch and therefore of said pressure pad, to maintain said predetermined gap.

7. In a blanking and drawing press comprising a ram and a bed; a cylinder in the ram and a piston in said cylinder, means for controlling the pressure in said cylinder above said piston, the lower side of said piston being vented to atmosphere, a plurality of pressure pins positioned to abut the bottom of said piston, an annular pressure pad secured to said ram and positioned to abut the lower ends of said pressure pins, and a draw punch secured to said ram; a blanking punch and a blanking die mounted on said bed, a movvable stripper positioned to be abutted by said blanking punch, a fixed spacer in said bed to limit the movement of said blanking punch, a draw die in said bed, said pressure pad clamping the edge of said blank against said draw die under the controlled pressure above said piston; said piston yielding as said ram descends, and maintaining the gap established by said spacer to prevent thinning and clipping of ears, and maintaining clamping pressure to prevent wrinkling.

* * * * *